US009464445B2

(12) United States Patent
Ben-Ezri

(10) Patent No.: US 9,464,445 B2
(45) Date of Patent: Oct. 11, 2016

(54) COMPOSITE STRUCTURAL ELEMENT

(71) Applicant: Sigment Design Metals Ltd., Bear-Sheva (IL)

(72) Inventor: Albert Ben-Ezri, Beer-Sheva (IL)

(73) Assignee: Sigment Design Metals Ltd., Bear-Sheva (IL)

( * ) Notice: Subject to any disclaimer, the term of this patent is extended or adjusted under 35 U.S.C. 154(b) by 175 days.

(21) Appl. No.: 14/379,775

(22) PCT Filed: Feb. 21, 2013

(86) PCT No.: PCT/IL2013/050160

§ 371 (c)(1),
(2) Date: Aug. 20, 2014

(87) PCT Pub. No.: WO2013/124854

PCT Pub. Date: Aug. 29, 2013

(65) Prior Publication Data

US 2015/0030798 A1 Jan. 29, 2015

Related U.S. Application Data

(60) Provisional application No. 61/634,156, filed on Feb. 24, 2012.

(51) Int. Cl.
*E04F 15/02* (2006.01)
*E04C 2/32* (2006.01)

(52) U.S. Cl.
CPC ..... *E04F 15/02194* (2013.01); *E04C 2/324* (2013.01); *E04F 15/02166* (2013.01); *E04F 2201/0153* (2013.01); *Y10T 428/21* (2015.01); *Y10T 428/24008* (2015.01); *Y10T 428/24612* (2015.01)

(58) Field of Classification Search
CPC ..... E04F 15/02194; E04F 15/02166; E04C 2/324
USPC ..... 428/67
See application file for complete search history.

(56) References Cited

U.S. PATENT DOCUMENTS 2,077,749 A * 4/1937 Fischer ..... E01C 11/24 404/21
5,103,608 A 4/1992 Andreo

FOREIGN PATENT DOCUMENTS

AT 334046 12/1976
CN 102528862 7/2012
DE 10307541 A1 * 9/2004 ..... A47B 77/022

(Continued)

OTHER PUBLICATIONS

European Office Action of European Application No. 13751516.9 dated Jun. 5, 2015.
European Search Report for EP Application No. EP 13 75 1516 dated Jul. 25, 2014.
International Search Reort of Application No. PCT/IL2013/050160 mailed onJun. 20, 2013.

*Primary Examiner* — Brent O'Hern
(74) *Attorney, Agent, or Firm* — Pearl Cohen Zedek Latzer Baratz LLP

(57) ABSTRACT

A composite structural element is provided herein, which comprises a basal member having voids of a predefined shape that are open to a surface thereof; and filling elements designed to fit into the voids. The predefined shape of the voids and/or an interface between the filling elements and the voids are arranged to maintain the filling elements within the voids.

20 Claims, 7 Drawing Sheets

(56) References Cited

FOREIGN PATENT DOCUMENTS

| | | |
|---|---|---|
| DE | 10307541 | 9/2014 |
| EP | 2615220 | 7/2013 |
| FR | 2773828 | 7/1999 |
| GB | 1222831 | 2/1971 |
| GB | 2339437 | 1/2000 |
| JP | 2006009490 | 1/2006 |
| WO | WO-00/29676 | 5/2000 |
| WO | WO-01/89786 | 11/2001 |
| WO | WO 2011/064263 | 5/2011 |

* cited by examiner

COMPOSITE STRUCTURAL ELEMENT

CROSS-REFERENCE TO RELATED APPLICATIONS

This application is a National Phase Application of PCT International Application No. PCT/IL2013/050160, International Filing Date Feb. 21, 2013, claiming priority of U.S. Patent Application No. 61/634,156, filed Feb. 24, 2012, which is hereby incorporated by reference.

BACKGROUND

1. Technical Field

The present invention relates to the field of structural elements, and more particularly, to composite structural elements.

2. Discussion of Related Art

Common tiles and covers are made of a single material and are passive elements.

BRIEF SUMMARY

One aspect of the present invention provides a composite structural element comprising: a basal member having voids of a predefined shape that are open to a surface thereof; and a plurality of filling elements designed to fit into the voids, wherein at least one of the predefined shape of the void and an interface between the filling elements and the voids is arranged to maintain the filling elements within the voids.

These, additional, and/or other aspects and/or advantages of the present invention are: set forth in the detailed description which follows; possibly inferable from the detailed description; and/or learnable by practice of the present invention.

BRIEF DESCRIPTION OF THE DRAWINGS

For a better understanding of embodiments of the invention and to show how the same may be carried into effect, reference will now be made, purely by way of example, to the accompanying drawings in which like numerals designate corresponding elements or sections throughout.

In the accompanying drawings.

DETAILED DESCRIPTION

Figure 1A:
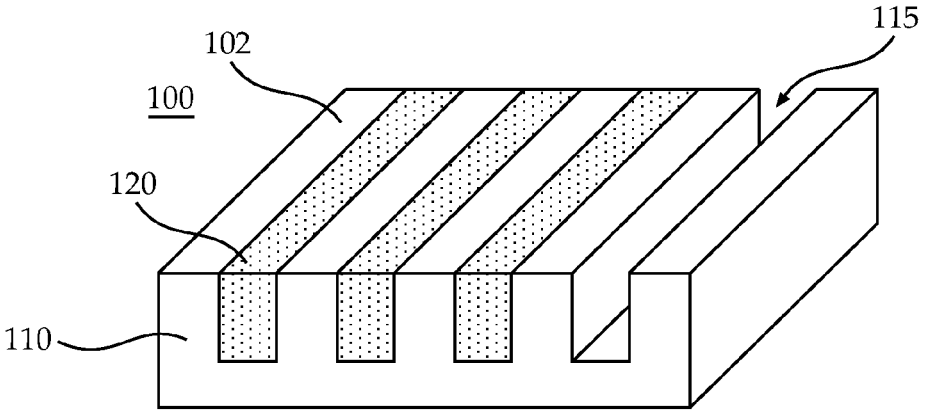
FIGS. 1A-1D are high level schematic perspective illustrations of flat composite structural elements, according to some embodiments of the invention.
Figure 1B:
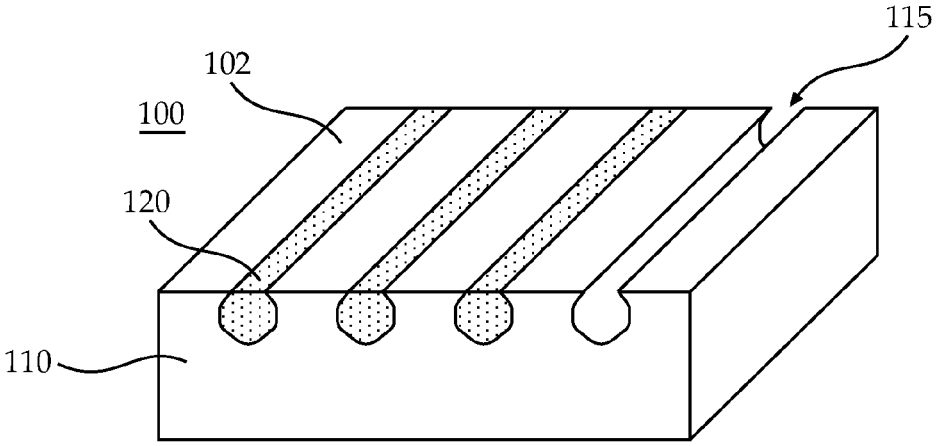

With specific reference now to the drawings in detail, it is stressed that the particulars shown are by way of example and for purposes of illustrative discussion of the preferred embodiments of the present invention only, and are presented in the cause of providing what is believed to be the most useful and readily understood description of the principles and conceptual aspects of the invention. In this regard, no attempt is made to show structural details of the invention in more detail than is necessary for a fundamental understanding of the invention, the description taken with the drawings making apparent to those skilled in the art how the several forms of the invention may be embodied in practice.

Before explaining at least one embodiment of the invention in detail, it is to be understood that the invention is not limited in its application to the details of construction and the arrangement of the components set forth in the following description or illustrated in the drawings. The invention is applicable to other embodiments or of being practiced or carried out in various ways. Also, it is to be understood that the phraseology and terminology employed herein is for the purpose of description and should not be regarded as limiting.

Figure 1C:
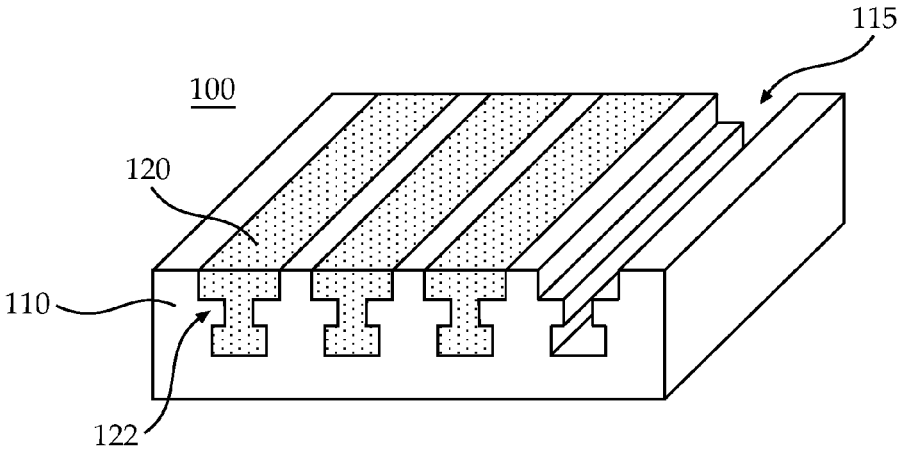
Figure 1D:
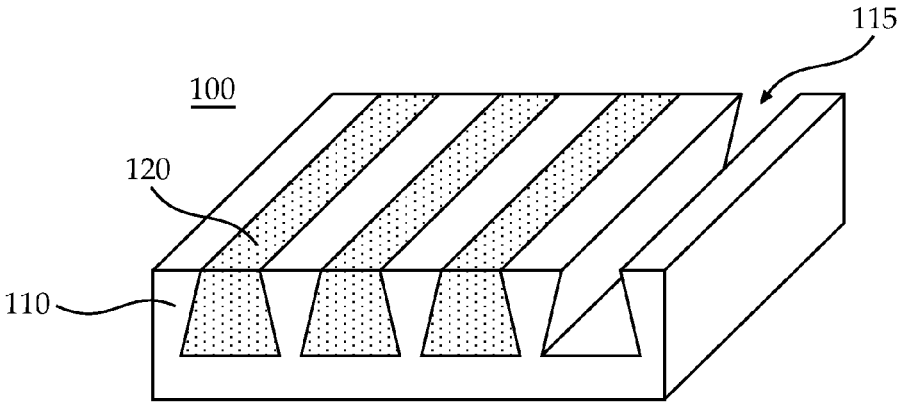
Figure 2:
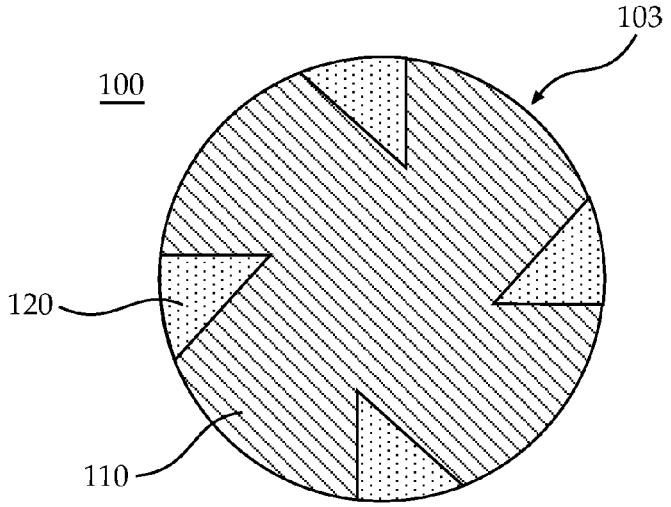
FIG. 2 is a high level schematic cross section illustration of a round composite structural element, according to some embodiments of the invention.
Figure 3:
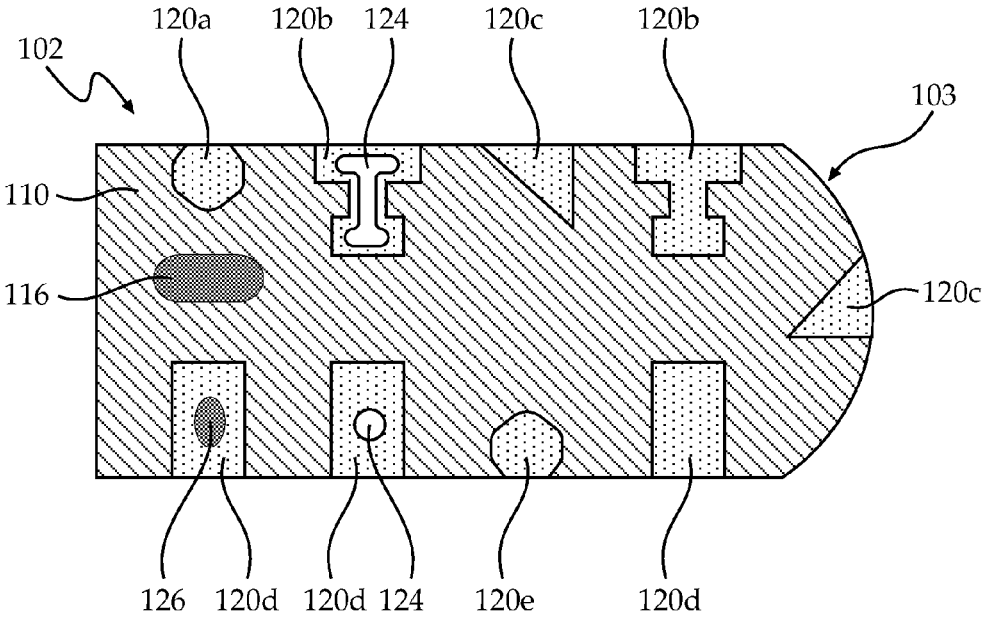
FIG. 3 is a high level aggregation of schematic cross section illustrations of various combinations of voids and filling elements, according to some embodiments of the invention.

FIGS. 1A-1D are high level schematic perspective illustrations of flat composite structural elements 100, according to some embodiments of the invention. FIG. 2 is a high level schematic cross section illustration of round composite structural element 100, according to some embodiments of the invention. FIG. 3 is a high level aggregation of schematic cross section illustrations of various combinations of voids 115 and filling elements 120, according to some embodiments of the invention.

Composite structural element 100 comprises a basal member 110 having voids 115 of a predefined shape that are open to a surface thereof, and a plurality of filling elements 120 designed to fit into voids 115. In embodiments, filling elements 120 may be designed to fit into voids 115 to yield a smooth surface of composite element 100. The smooth surface of composite element 100 may be flat as illustrated in FIGS. 1A-1D (indicated by arrow 102) or circular as illustrated in FIG. 2 (indicated by arrow 103) or have a different form. In embodiments, filling elements 120 may be designed to protrude from voids 115 or partially fill voids 115, as illustrated below.

In particular, composite structural element 100 is designed to meet strength requirements and basal member 110 and filling elements 120 are designed to have sufficient bending and pressing strengths that keep them intact and interconnected under expected environmental conditions, including thermal, mechanical and chemical influences.

In embodiments, the predefined shape of void 115 and/or the interface between filling elements 120 and voids 115 is arranged to maintain filling elements 120 within voids 115. For example, filling elements 120 may be designed to fit into voids 115 in a compressed state, to yield a specified frictional force at the interface (e.g. independently of ambient conditions). In support of the compression, filling elements 120 may comprise one or more cavities 124 (see FIG. 3) that support the compression and expansion of filling elements 120. Cavities 124 may have any form that serves their function best. In another example, voids 115 and filling elements 120 may comprise corresponding waists 122 (a narrow middle section) as illustrated in FIG. 1C or may be trapezoid-shaped, as illustrated in FIG. 1D to have an inner section that is wider than an outer section.

Filling elements 120 may be made of various materials, such as wood, plastic, rubber, metal, glass, composite materials, cement, limestone glue powder, fiberglass, ceramics and combinations thereof. Basal member 110 may be made of various materials, such as wood, plastic, rubber, metal, glass, composite materials, cement, limestone glue powder, fiberglass, ceramics and combinations thereof.

The predefined shape of voids 115 and materials used for filling elements 120 and basal member 110 may be selected according to given strength and elasticity requirements. For example, the materials may be selected to optimize the mechanical parameters and characteristics of composite element 100, according to its use, regarding e.g. the weights that it is expected to hold, the required flexibility and brittleness, tensile strength etc. Filling elements 120 and basal member 110 may be selected to be complementary in these respects. In embodiments, the materials may be selected to minimize the weight of composite element 100 under given strength and elasticity requirements, applying e.g. criteria for determining the maximal shear stress of material failure. In embodiments, the materials may be selected to maximize the moment of inertia of composite element 100 to reduce the shear stress.

Engaging basal member 110 and filling elements 120 may be carried out by introducing filling elements 120 into voids 115 by pressing, click-connecting, transversal insertion and/or by producing of filling elements 120 within voids 115 (e.g. by extrusion into voids 115). For example, composite element 100 may be provided with a clamp hook that corresponding to clamp grooves in filling elements 120, or vice versa. The clamp hook of basal member 110 or voids 115 may be pressed on the clamp groove of filling elements 120, thereby integrating the metal profile and the filler-material profile. In embodiments, basal member 110 may be bonded with filling elements 120 as a whole body. In embodiments, filling elements 120 may be wrapped around basal member 110. In embodiments, composite element 100 may be produced by co-extruding filling elements 120 as a surface layer and basal member 110 as a core layer. The above mentioned embodiments may be combined to produce any type of composite element 100.

Designing filling elements 120 may be carried out to provide a flat surface of composite element 100. Composite element 100 may further be laminated, e.g. by co-extrusion, gluing or any other method. The lamination can be on the upper side, lower side or both sides of the new composite profile.

These combinations of these two materials together in one profile provide composite profile with improved strength within a thin layer. It also gives more elasticity to the profile and strength to bending. When a device is inserted into the metal or the filler materials there is an option to enhance the device's performance and functionality.

FIG. 3 illustrates an aggregation of various combinations of voids 115 and filling elements 120. Each of the forms may be used by itself in structural element 100. For example, the shapes of voids 115 and filling elements 120 may be a rectangle 120D, a polygon 120A, an I-shape 120B, a trapezoid (FIG. 1D) or a triangle 120C. Embodiments may include any shape of void 115 which holds filling elements 120 and prevents them from moving or creeping out of voids 115.

In embodiments, one or more of filling elements 120 may comprise sensor(s), transmitters and/or receivers, light source(s), wiring(s) and heating element(s) all indicated by a generic member 126.

Sensors may be used e.g. to measure pressure, temperature, electric or magnetic fields, electromagnetic radiation, illumination, capacity, conductivity ("touch-tiles") to detect movements or illumination of composite element 100 such as a tile.

Transmitters and/or receivers may relate to electromagnetic radiation such as RF, X-ray or microwaves; and pressure such as ultrasound, sound or other vibrations.

Light sources such as light emitting diode (LEDs) or optical fibers may be used to create e.g. floor illumination by composite element 100.

Wiring may be integrated within composite element 100 to yield a highly modular wiring system, e.g. in a floor, sparing the need for additional installation. Wiring may comprise electric wires (power or data), optical fibers etc. Heating elements may be used to replace other heating sources and provide integrated heating. Alternatively or additionally, composite structural element 100 may be heat conductive (e.g. made of metal) and comprise heating elements 116 embedded within basal member 110. Other elements, such as sensors, light sources and wiring may as well be integrated within basal member 110. Either or both basal member 110 and filling elements 120 may be heat conductive comprise heating element 116 embedded in basal member and/or filling elements 120, respectively. Either or both basal member 110 and filling elements 120 may be electrically conductive.

Composite element 100 may at least one device attached to it or embedded in the internal space or a pipe that runs through composite element 100, such as heat condensers, electric circuitry or combinations thereof.

Composite element 100 may further be formed to have modular connections on its edges to connect to other elements and/or other composite elements 100, e.g. as tiles or covers. The modular connection may comprise electric, optical or fluid connections among members 126 and/or 116 in different elements.

Figure 4A:
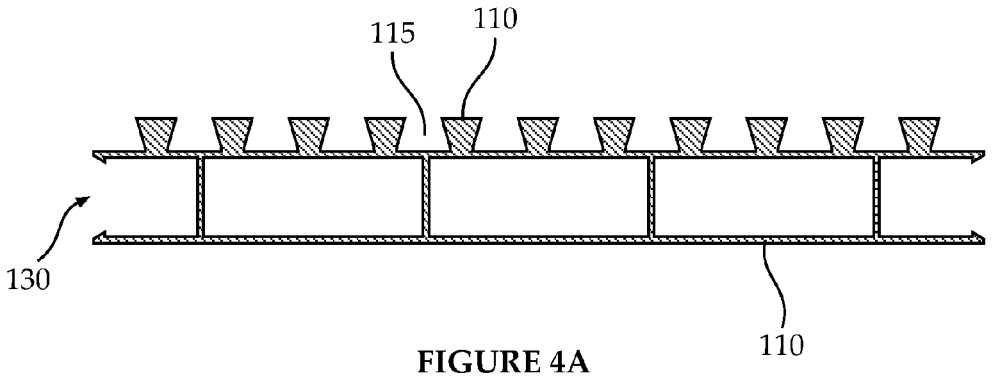
FIGS. 4A-4C are high level schematic cross section illustrations of the composite structural element, according to some embodiments of the invention.
Figure 4B:
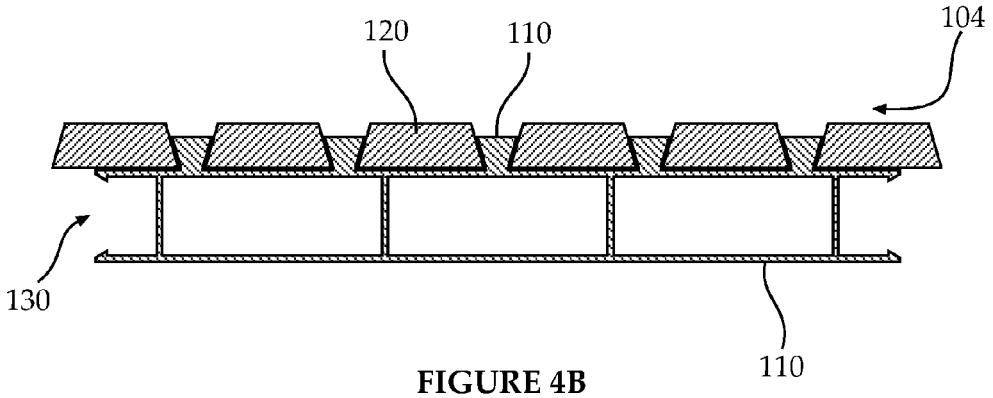
Figure 4C:
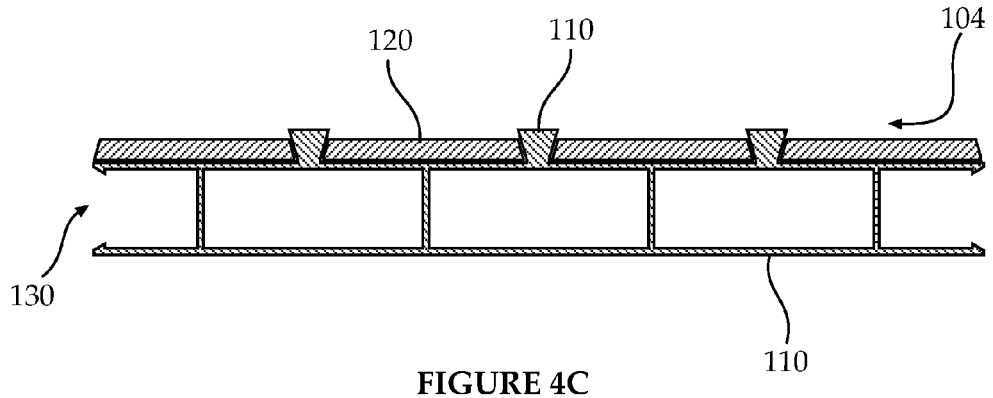

FIGS. 4A-4C are high level schematic cross section illustrations of the composite structural element, according to some embodiments of the invention.

Basal member 110 may be designed to engage a specified structural element such as standard tiles or other structural elements, via a joint 130 shaped to engage respective connective members 132 and sockets 133 (see FIGS. 5A-5F) in the standard tiles or other structural elements. Joint 130 may be realized as a click-snapping connector. Filling elements 120 may be placed above or be part of joint 130 (FIG. 4B). In embodiments, basal member 110 may have an arbitrary profile, optionally selected to correspond to given as standard tiles or other structural elements.

In embodiments, voids 115 may be trapezoid as illustrated in FIGS. 4A-4C. The constriction of the external edge of voids 115 is used to hold filling elements 120 in place and furthermore to enhance the strength of composite element 100 and to prevent separation or removal of filling elements 120 from voids 115. In particular, an inclination of the void sides that is larger than 6° from the vertical was found to contribute significantly to the strength and stability of composite element 100. Generally, voids 115 and filling elements 120 may have an external short side and an internal long side, both with respect to basal member 110, and further have edges connecting the external short side to the internal long side, which are inclined at at least 6°. The actual form of voids 115 and filling elements 120 may vary, e.g. be curved with the edges beings arcs.

In embodiments, filling elements 120 may be designed to protrude from voids 115 above a surface 104 of structural element 100 (FIG. 4B), e.g. to protect basal member 110. In embodiments, filling elements 120 may be designed to partially fill voids 115 such that they do not reach surface 104 of structural element 100 (FIG. 4C), e.g. to protect filling elements 120. In embodiments, the protruding element, be it filling elements 120 or basal member 110, may protect the lower lying element (basal member 110 or filling elements 120 respectively) from abrasion. In particular, filling elements 120 may protrude from surface 104 of basal member 110 and be designed to protect surface 104 of basal member 110 from abrasion; or filling elements 120 may be depressed with respect to surface 104 of basal member 110 and be protected by surface 104 of basal member 110 from abrasion. The materials may be appropriately selected to provide for abrasion protection.

Advantageously, composite element 100 combines the material characteristics of basal member 110 and filling elements 120 and enhances them by integrating various elements 126, 116 into the composite structure. Composite element 100 may be designed to be usable under various circumstances and provide novel design features.

Figure 5A:
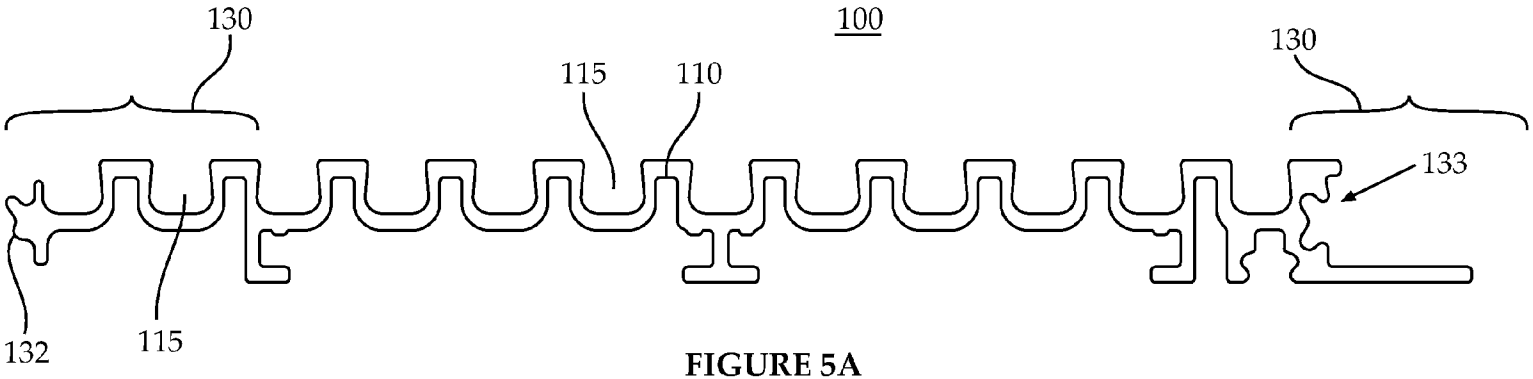
FIGS. 5A-5F are high level schematic cross section illustrations of composite structural elements with joints, according to some embodiments of the invention.
Figure 5B:
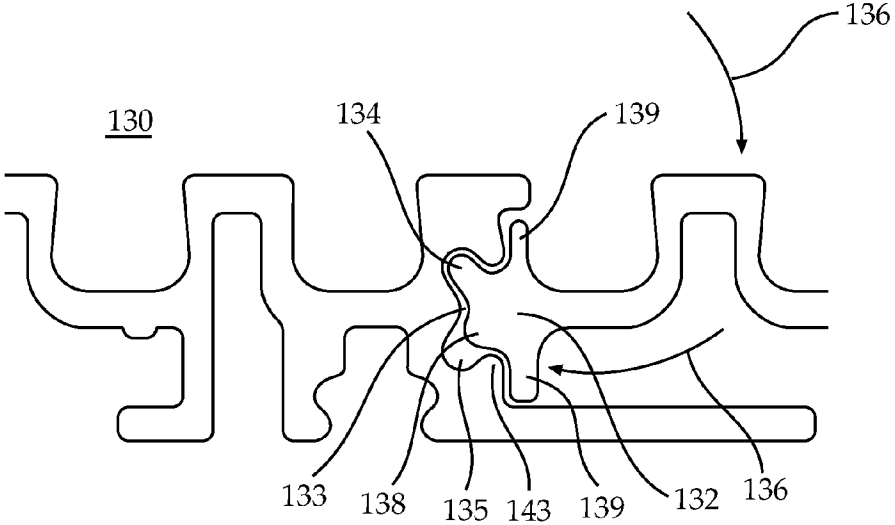
Figure 5C:
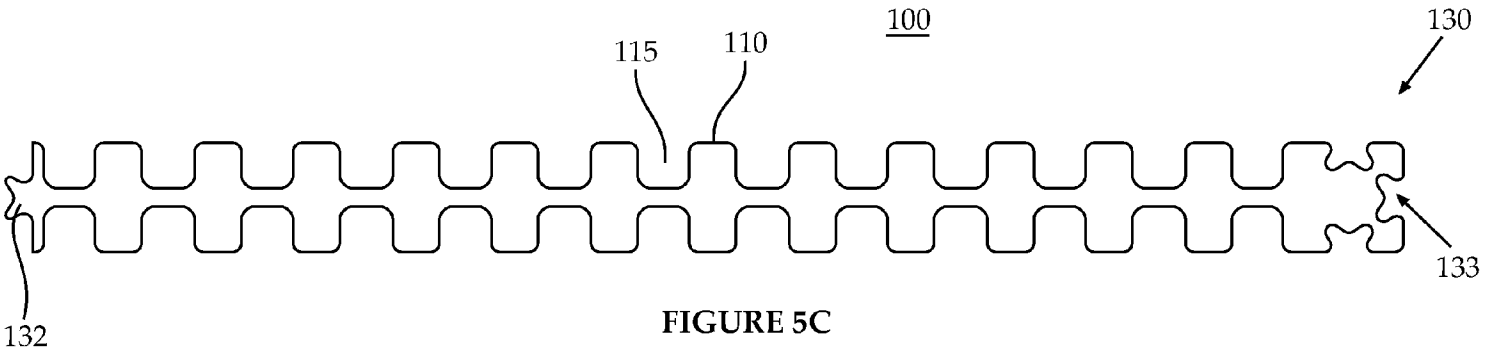
Figure 5D:
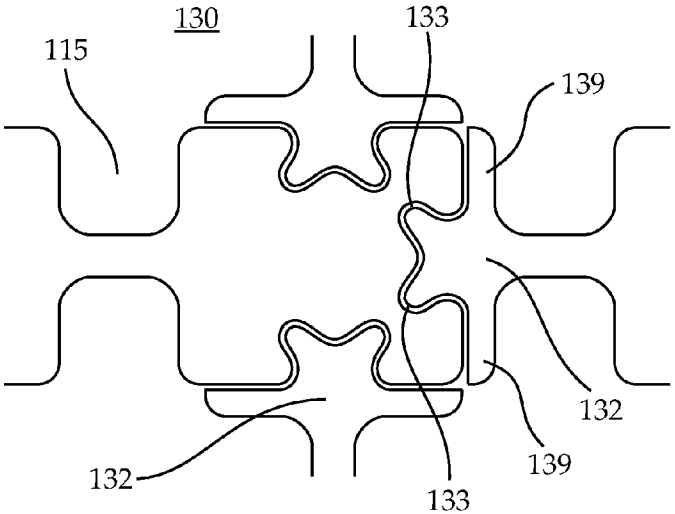
Figure 5E:
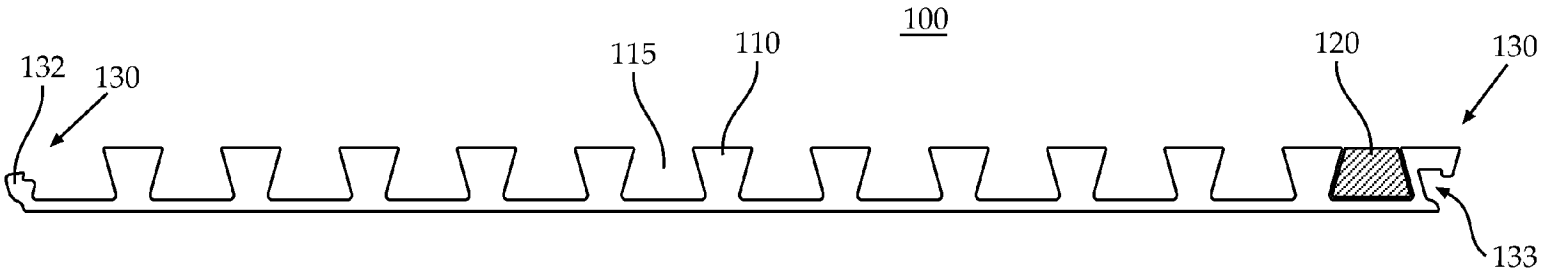
Figure 5F:
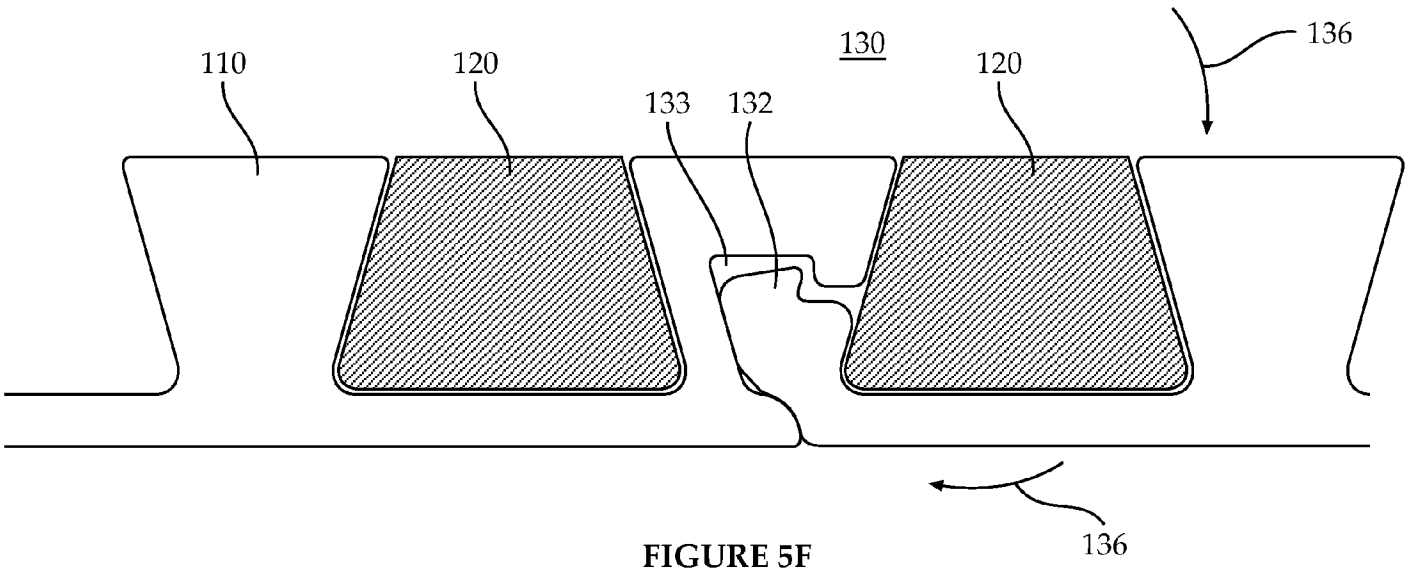

FIGS. 5A-5F are high level schematic cross section illustrations of composite structural elements 100 with joints 130 to adjacent elements 100, according to some embodiments of the invention. FIGS. 5B, 5D and 5F illustrate joints 130 between elements 100 of FIGS. 5A, 5C and 5E, respectively.

FIGS. 5A and 5B illustrate composite element 100 with filling elements 120 having joint 130 comprising a connective member 132 that is designed to fit into a corresponding socket 133. Connective member 132 has two protrusions 134, 138 fitting into recesses 135 in socket 133. Adjacent elements 100 may be hingedly attachable to each other, as in the illustrated case, in which one of protrusions 134 is smaller than corresponding recess 135 in order to allow easy connecting of one element 100 to the other. Element 100 having connective member 132 may be placed obliquely next to element 100 having socket 133 and connected to it by placing oblique element 100 (in a direction along arrow 136) with connective member 132 acting as a hinge for the placing operation. The trimming of the respective protrusion 134 allows connective member 132 to rotate into engaged position with socket 133 without being obstructed by socket edge 143. Additional protrusions 139 of connective member 132 assure a correct and continuous placing of elements 100.

FIGS. 5C and 5D illustrate composite element 100 having joint 130 with multiple sockets 133 that is designed to interconnect multiple elements 100 to each other, in the illustrated example at angles of 90°, 180° and 270° to form crossed composite elements 100. Additional protrusions 139 may be provided to stabilize the connection.

FIGS. 5E and 5F illustrate composite element 100 with filling elements 120 having joint 130 comprising an asymmetric connective member 132 that is designed to fit into a corresponding asymmetric socket 133. Adjacent elements 100 may be hingedly attachable to each other, as in the illustrated case, in which asymmetric connective member 132 is smaller than corresponding asymmetric socket 133 in order to allow easy connecting of one element 100 to the other. Element 100 having connective member 132 may be placed obliquely next to element 100 having socket 133 and connected to it by placing oblique element 100 (in a direction along arrow 136) with connective member 132 acting as a hinge for the placing operation. The trimming of connective member 132 allows it to rotate into engaged position with socket 133. Filling elements 120 may be designed to stabilize and seal joint 130 and allow thereby easy mounting of elements 100. Furthermore, filling elements 120 may be designed to conceal joints 130 to present the combined elements 100 as a uniform surface.

Composite element 100 may be used in various applications depending on the materials combined into the composite profile and on the attached elements. Examples for applications comprise:

Decking such as decoration decks with several different surface coatings and comprising illumination.

Kitchen or bathroom tiles, with or without heating elements.

Floor or ceiling tiles, optionally water-sealed, with or without wiring for electricity or communications and piping.

Furniture such as tables, benches, chairs, with or without illumination.

Aesthetic and decorated covers for walls and floors.

Frames of any kind of frames, e.g. using lightweight and strong materials, optionally comprising sensors and controlled illumination.

Green building with control of heat transfer parameters.

Shafts with specified strength, elasticity and heat conductivity characteristics.

Flooring plate of lightweight and strong material that can sustain great loads and can be made anti-corrosive (e.g. boat floors, boat body, aircraft, vehicles etc.), with or without heating elements, illumination and sensors that are usable under the "smart home" concept.

Advantageously, filling elements 120 may be designed to reinforce composite element 100, seal and hide connection regions between adjacent elements (e.g. by fully or partially covering joint 130) and generate a uniform appearance of connected elements.

In the above description, an embodiment is an example or implementation of the invention. The various appearances of "one embodiment", "an embodiment" or "some embodiments" do not necessarily all refer to the same embodiments.

Although various features of the invention may be described in the context of a single embodiment, the features may also be provided separately or in any suitable combination. Conversely, although the invention may be described herein in the context of separate embodiments for clarity, the invention may also be implemented in a single embodiment.

Embodiments of the invention may include features from different embodiments disclosed above, and embodiments may incorporate elements from other embodiments disclosed above. The disclosure of elements of the invention in the context of a specific embodiment is not to be taken as limiting their used in the specific embodiment alone.

Furthermore, it is to be understood that the invention can be carried out or practiced in various ways and that the invention can be implemented in embodiments other than the ones outlined in the description above.

The invention is not limited to those diagrams or to the corresponding descriptions. For example, flow need not move through each illustrated box or state, or in exactly the same order as illustrated and described.

Meanings of technical and scientific terms used herein are to be commonly understood as by one of ordinary skill in the art to which the invention belongs, unless otherwise defined.

While the invention has been described with respect to a limited number of embodiments, these should not be construed as limitations on the scope of the invention, but rather as exemplifications of some of the preferred embodiments. Other possible variations, modifications, and applications are also within the scope of the invention. Accordingly, the scope of the invention should not be limited by what has thus far been described, but by the appended claims and their legal equivalents.

What is claimed is:

1. A composite structural element comprising:

a basal member having voids of a predefined shape that are open to a surface thereof; and a plurality of filling elements designed to fit into the voids, wherein at least one of the predefined shape of the void and an interface between the filling elements and the voids is arranged to maintain the filling elements within the voids, wherein at least one of the basal member and the filling elements is electrically conductive.

2. The composite structural element of claim 1, designed to have a flat or a circular smooth surface.

3. The composite structural element of claim 1, wherein the filling elements protrude from a surface of the basal member and are designed to protect the surface of the basal member from abrasion.

4. The composite structural element of claim 1, wherein the filling elements are depressed with respect to a surface of the basal member and are protected by the surface of the basal member from abrasion.

5. The composite structural element of claim 1, wherein the filling elements are designed to fit into the voids in a compressed state, to yield a specified frictional force at the interface, and optionally comprise at least one cavity.

6. The composite structural element of claim 1, wherein the voids and the filling elements comprise corresponding waists.

7. The composite structural element of claim 1, wherein the voids and the filling elements have a shape selected from: a rectangle, a polygon, an I-shape, a trapezoid and a triangle.

8. The composite structural element of claim 1, wherein the voids and the filling elements are trapezoid having an external short base and an edge inclination of at least 6°.

9. The composite structural element of claim 1, wherein the voids and the filling elements have an external short side and an internal long side, both with respect to the basal member, and further have edges connecting the external short side to the internal long side, which are inclined at least 6°.

10. The composite structural element of claim 1, wherein at least one of the filling elements further comprises at least one of: a sensor, a transmitter, a receiver, a light source, wiring and a heating element.

11. The composite structural element of claim 1, wherein the predefined shape of the voids and materials used for the filling elements and the basal member are selected according to given strength and elasticity requirements.

12. The composite structural element of claim 1, wherein the filling elements comprise at least one: wood, plastic, rubber, metal, glass, composite materials, cement, limestone glue powder, fiberglass, ceramics and combinations thereof.

13. The composite structural element of claim 1, wherein the basal member comprises at least one: wood, plastic, rubber, metal, glass, composite materials, cement, limestone glue powder, fiberglass, ceramics and combinations thereof.

14. The composite structural element of claim 1, wherein at least one of the basal member and the filling elements is heat conductive and further comprises a heating element embedded in the at least one of the basal member and the filling elements, respectively.

15. The composite structural element of claim 1, wherein the basal member and the filling elements are designed to engage by introducing the filling elements into the voids by at least one of: pressing, click-connecting, transversal insertion and upon production of the filling elements.

16. The composite structural element of claim 1, wherein the basal member is designed to engage a specified structural element via a joint.

17. The composite structural element of claim 1, further comprising a connective member arranged to hingedly attach to a socket in an adjacent element.

18. The composite structural element of claim 1, further comprising a joint arranged to interconnect a plurality of composite structural elements.

19. A composite structural element comprising:

a basal member having voids of a predefined shape that are open to a surface thereof; and a plurality of filling elements designed to fit into the voids, wherein at least one of the predefined shape of the void and an interface between the filling elements and the voids is arranged to maintain the filling elements within the voids, wherein the filling elements are at least one of: (i) depressed with respect to a surface of the basal member and are protected by the surface of the basal member from abrasion, (ii) designed to fit into the voids in a compressed state, to yield a specified frictional force at the interface and optionally comprising at least one cavity.

20. A composite structural element comprising:

a basal member having voids of a predefined shape that are open to a surface thereof; and a plurality of filling elements designed to fit into the voids, wherein at least one of the predefined shape of the void and an interface between the filling elements and the voids is arranged to maintain the filling elements within the voids, wherein at least one of the filling elements further comprises at least one of: a sensor, a transmitter, a receiver, a light source, wiring and a heating element, and/or wherein at least one of the basal member and the filling elements is heat conductive and further comprises a heating element embedded in the at least one of the basal member and the filling elements, respectively.

* * * * *